US009722321B2

(12) United States Patent
Bisiules et al.

(10) Patent No.: US 9,722,321 B2
(45) Date of Patent: Aug. 1, 2017

(54) FULL WAVE DIPOLE ARRAY HAVING IMPROVED SQUINT PERFORMANCE

(71) Applicant: CommScope Technologies LLC, Hickory, NC (US)

(72) Inventors: Peter J. Bisiules, LaGrange Park, IL (US); Alireza Shooshtari, Plan, TX (US)

(73) Assignee: CommScope Technologies LLC, Hickory, NC (US)

( * ) Notice: Subject to any disclaimer, the term of this patent is extended or adjusted under 35 U.S.C. 154(b) by 6 days.

(21) Appl. No.: 14/814,088

(22) Filed: Jul. 30, 2015

(65) Prior Publication Data

US 2016/0248170 A1 Aug. 25, 2016

Related U.S. Application Data

(60) Provisional application No. 62/120,689, filed on Feb. 25, 2015.

(51) Int. Cl.
*H01Q 21/08* (2006.01)
*H01Q 9/16* (2006.01)
(Continued)

(52) U.S. Cl.
CPC ..... *H01Q 21/08* (2013.01); *H01Q 1/246* (2013.01); *H01Q 5/42* (2015.01); *H01Q 9/16* (2013.01); *H01Q 21/24* (2013.01)

(58) Field of Classification Search
CPC ..... H01Q 21/08; H01Q 9/16
(Continued)

(56) References Cited

U.S. PATENT DOCUMENTS

2007/0241983 A1* 10/2007 Cao ..... H01Q 9/28 343/797
2012/0280872 A1* 11/2012 Werner ..... H01Q 15/0053 343/753
(Continued)

FOREIGN PATENT DOCUMENTS

WO WO 2005/122331 A1 12/2005

OTHER PUBLICATIONS

Doane et al., IEEE Transactions on Antennas and Propagation, IEEE Service Center, Piscatawa, NJ, US, vol. 61, No. 9, Sep. 1, 2013, pp. 4538-4548.
(Continued)

*Primary Examiner* — Dameon E Levi
*Assistant Examiner* — Andrea Lindgren Baltzell
(74) *Attorney, Agent, or Firm* — Myers Bigel, P.A.

(57) ABSTRACT

A cellular base station antenna having improves squint performance is provided. The antenna includes a ground plane, a first plurality of radiating elements supported over the ground plane by microstrip support PCBs, and a second plurality of radiating elements supported over the ground plane by stripline support PCBs. The first and second pluralities of radiating elements are arranged in at least one array of low band radiating elements, and the quantities of first and second pluralities of radiating elements are selected to reduce squint of a beam produced by the at least one array. The first plurality of radiating elements may be located below the second plurality of radiating elements in the array. The array may be arranged in a linear column or a staggered column. In one example, the first plurality of radiating elements comprises four radiating elements and the second plurality radiating elements comprises two radiating elements.

20 Claims, 10 Drawing Sheets

(51) Int. Cl.
*H01Q 1/24* (2006.01)
*H01Q 21/24* (2006.01)
*H01Q 5/42* (2015.01)

(58) Field of Classification Search
USPC ..... 343/727
See application file for complete search history.

(56) References Cited

U.S. PATENT DOCUMENTS

| | | | | |
|---|---|---|---|---|
| 2014/0028516 | A1 | 1/2014 | Semonov et al. | |
| 2014/0139387 | A1* | 5/2014 | Jones | H01Q 21/30 343/794 |
| 2014/0218254 | A1* | 8/2014 | Kitchener | H01Q 9/16 343/834 |

OTHER PUBLICATIONS

International Search Report regarding PCT/US2015/039742 dated Nov. 10, 2015 (5 pgs.).
Written Opinion of the International Searching Authority regarding PCT/US2015/039742 dated Nov. 10, 2015 (8 pgs.).

* cited by examiner

| Name | | Min | Max | Mean | StdV | Tol |
|---|---|---|---|---|---|---|
| Overall | | -8.88 | 11.24 | 0.12 | 4.32 | 6.48 |
| LB_LP_T0 | | -1.75 | 3.16 | 1.40 | 1.55 | 2.32 |
| LB_LP_T7 | | 0.42 | 6.18 | 3.53 | 1.56 | 2.34 |
| LB_LP_T15 | | -2.00 | 11.24 | 5.38 | 3.35 | 5.02 |
| LB_RP_T0 | | -3.06 | 2.08 | -0.51 | 1.41 | 2.12 |
| LB_RP_T7 | | -5.29 | -0.87 | -3.00 | 1.22 | 1.82 |
| LB_RP_T15 | | -8.88 | -1.43 | -6.09 | 1.67 | 2.51 |

FULL WAVE DIPOLE ARRAY HAVING IMPROVED SQUINT PERFORMANCE

STATEMENT OF RELATED APPLICATIONS

This application claims priority to U.S. Provisional Patent Application Ser. No. 62/120,689, filed Feb. 25, 2015, the disclosure of which is incorporated by reference.

FIELD OF THE INVENTION

The present invention relates to antennas comprising arrays of radiating elements. In particular, the present invention provides improved squint performance for arrays of radiating elements.

BACKGROUND

Arrays of full wave dipole radiating elements have been observed to suffer from squint at high electrical down tilt angles. The term "squint" means the amount that a beam peak (midpoint between −3 dB angles) deviates from boresight of the antenna. See, for example, FIG. 9, which illustrates an azimuth beam pattern having approximately 12° of squint. A "full wave" dipole radiating element is a type of dipole that is designed such that its second resonant frequency is in the desired frequency band. In this type of dipole, the dipole arms are dimensioned such that the two dipole arms together span about three-quarters to one full wavelength of the desired operational frequency band. This is in contrast to "half-wave" dipoles, where the dipole arms are about one quarter wavelength of the operating band, and the two dipole arms together have a length of about one half the wavelength of the operating band.

While full wave dipoles have certain advantages in low band arrays of radiating elements in a multi-band array, known arrays of full wave dipoles typically experience disadvantageous coupling between two adjacent −45 degree polarization dipoles and +45 degree polarization dipoles, which may cause cross polarization and squint degradation at certain frequencies (referred to herein as "squint resonance frequency"). This effect particularly happens for the vertical polarization component of a slant dual-polarized dipole.

What is needed is an array of full wave dipole radiating elements with improved squint performance.

SUMMARY OF THE INVENTION

A cellular base station antenna having improves squint performance is provided. The antenna includes a ground plane, a first plurality of radiating elements supported over the ground plane by microstrip support PCBs, and a second plurality of radiating elements supported over the ground plane by stripline support PCBs. The first and second pluralities of radiating elements are arranged in at least one array of low band radiating elements, and the quantities of microstrip PCB elements and stripline PCB elements are selected to minimize squint of a beam pattern provided by the array. The first plurality of radiating elements may be located below the second plurality of radiating elements in the array. The array may be arranged in a linear column or a staggered column. In one example, the first plurality of radiating elements comprises four radiating elements and the second plurality radiating elements comprises two radiating elements.

In a preferred embodiment, the first and second pluralities of radiating elements comprise low band radiating elements of a multi-band antenna. The low band radiating elements may be full wave cross dipole radiating elements. The cellular base station antenna may further include at least one array of high band radiating elements. In another example, a second array of microstrip support PCB and stripline support PCB radiating elements may be provided.

The microstrip support PCBs may each comprise a hook balun, a feed stalk, an inductive section, and a capacitive section. The stripline support PCBs may each comprise a hook balun, at least two feed stalks sandwiching the hook balun, an inductive section, and a capacitive section.

DETAILED DESCRIPTION OF THE INVENTION

Figure 1A:
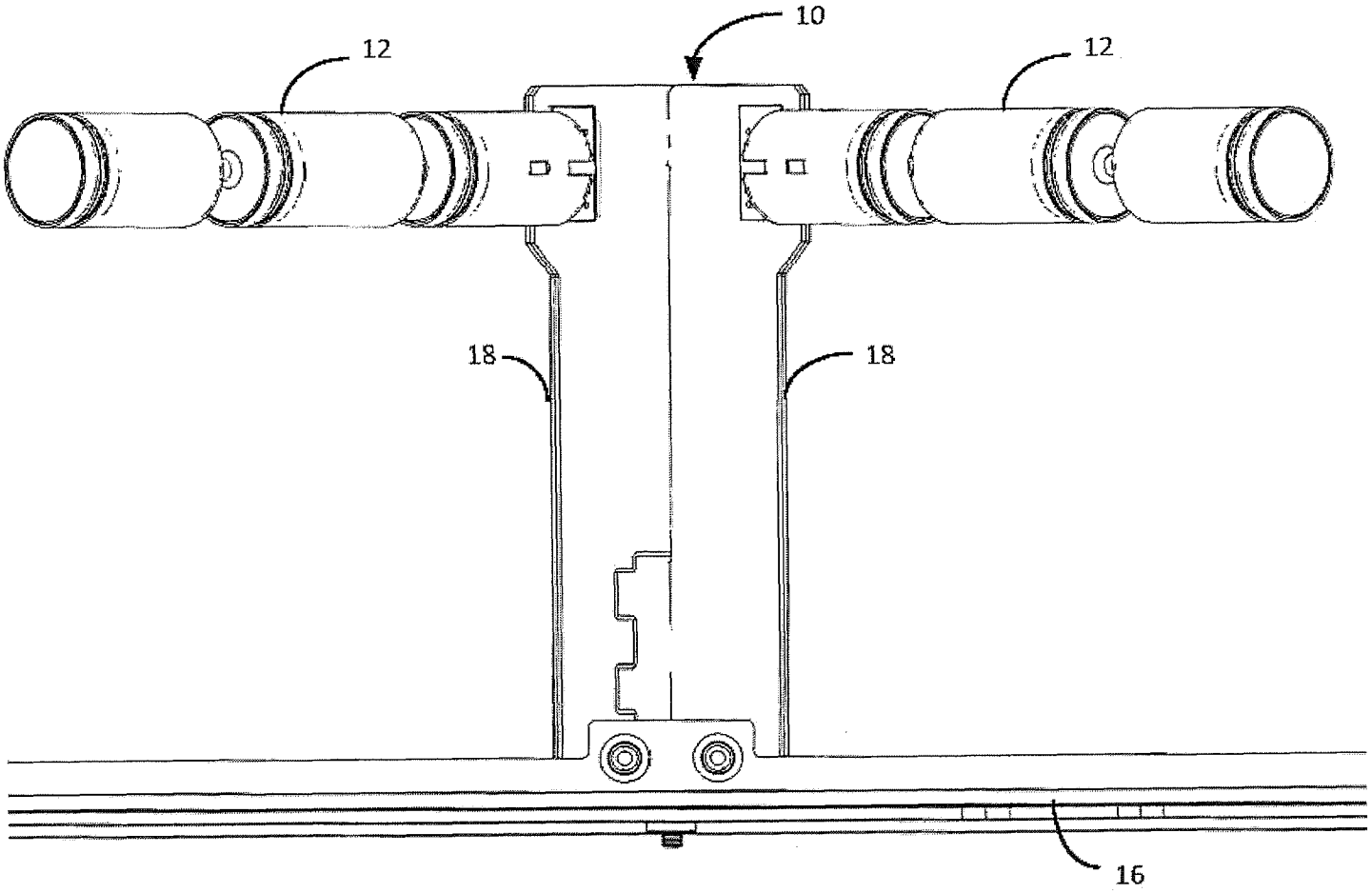
FIG. 1*a* is a side view of a low band radiating element having a microstrip support PCB which may be used in combination with additional elements to provide an antenna array according to one aspect of the present invention.

FIG. 1*a* illustrates one example of a microstrip support PCB radiating element 10. The microstrip support PCB radiating element 10 includes low band dipole arms 12 supported over a reflector 16 by microstrip support PCBs 18. In the illustrated examples, low band dipole arms 12 comprise full wave dipoles, which span from about three-quarters to one full wavelength of an operating frequency band of microstrip support PCB radiating element 10. Optionally, the low band dipole arms 12 include RF chokes that are resonant at high band frequencies to minimize scattering of high band elements. See, e.g., International Pat. Pub. No. WO 2014100938, (the "'938 Application."), which is incorporated by reference.

Figure 1B:
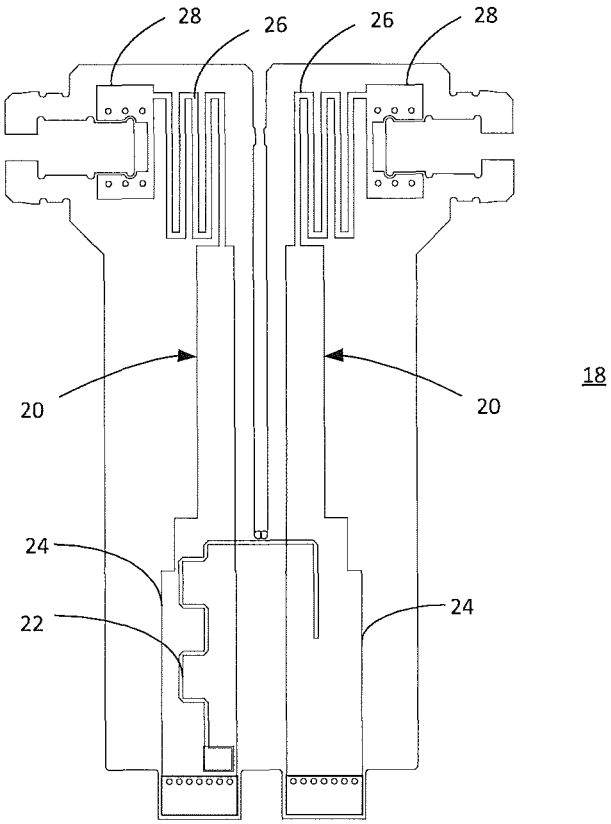
FIG. 1*b* is a detailed view of microstrip support PCB of the low band element of FIG. 1*a*.

In the microstrip support PCB radiating element 10, the low band dipole arms 12 are excited by microstrip support PCBs 18 (FIG. 1*b*). The term "microstrip," as used herein, has its conventional meaning of a conducting strip separated from a ground plane by a dielectric layer, often fabricated on a printed circuit board. The microstrip construction in this example comprises feed circuit 20 and a hook balun 22. Each feed circuit 20 comprises a feed stalk 24, an inductive section 26, and a capacitive section 28.

FIG. 1*b* illustrates the metallization layers of one of the microstrip support PCBs 18 of the microstrip support PCB radiating element 10 of FIG. 1*a*. The hook balun 22 is connected to an array feed network of an antenna. The array feed network may comprise a conventional corporate feed network. Optionally, the array feed network includes variable phase shifters to adjust relative phase relationships between radiating elements, thereby adjusting an electrical downtilt angle of the array. The hook balun 22 then couples the RF signals from the feed network to a feed circuits 20 on the microstrip support PCB 18. Unbalanced RF signals from the feed network are coupled into feed stalks 24 as balanced signals. Each feed stalk 24 is coupled to a capacitive section 28 for coupling to the low band dipole arms 12 by way of the inductive section 26, which is included for impedance matching.

Figure 2:
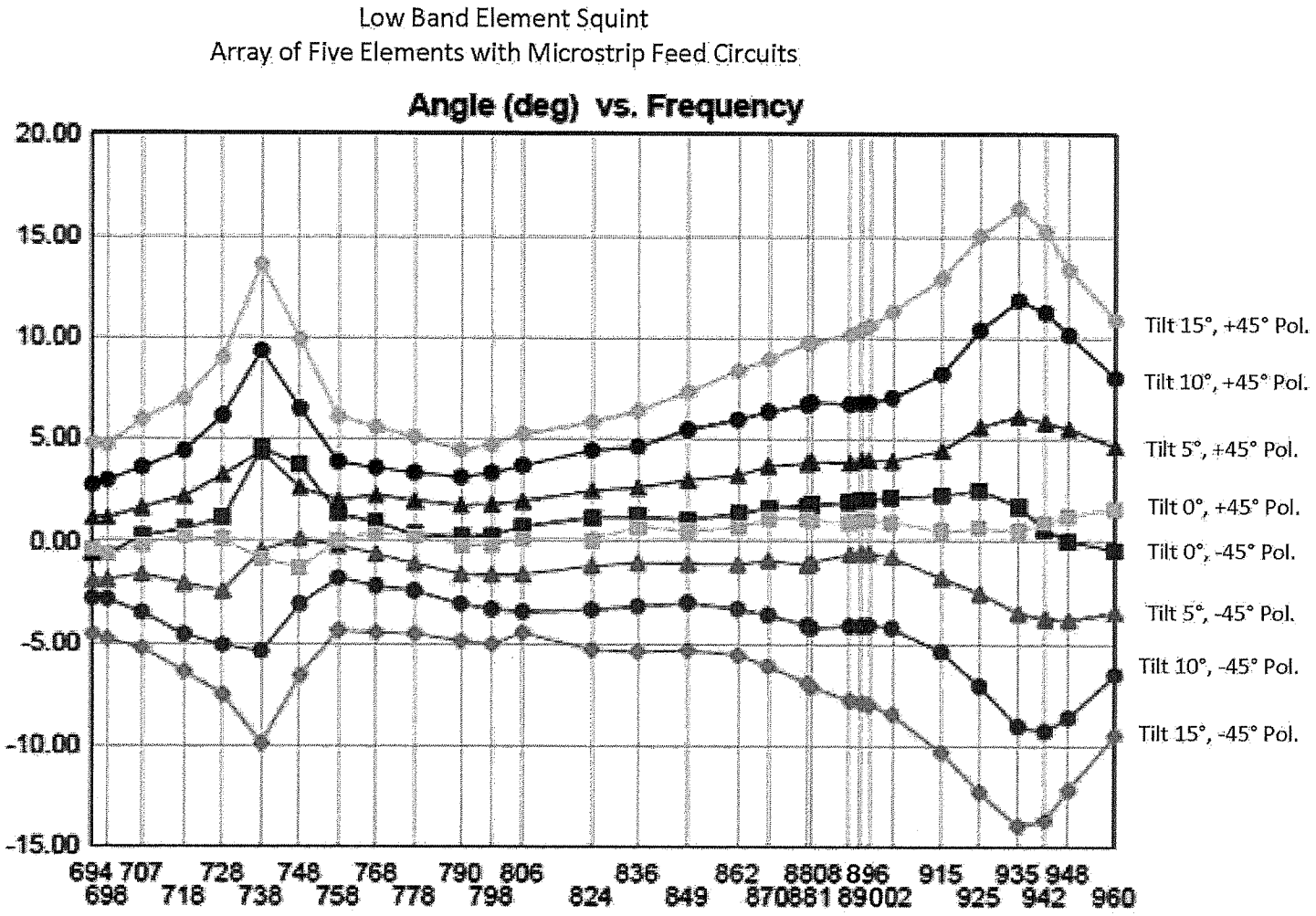
FIG. 2 illustrates squint performance of an antenna array which is composed solely of radiating elements and microstrip support PCBs as illustrated in FIGS. 1*a* and 1*b*.

FIG. 2 illustrates squint degradation for an array of five full-wave, low band, microstrip support PCB radiating element 10 excited by microstrip support PCBs 18. Squint degradation increases as electrical downtilt angle increases, and the microstrip support PCB elements exhibit squint resonance frequencies at 738 MHz and 935 MHz. For example, squint exceeds 15° for 15° of downtilt for +45° polarization at 935 MHz, and approaches 15° for the −45° polarization. At 10° electrical downtilt, squint exceeds 5° for much of the band.

Figure 3A:
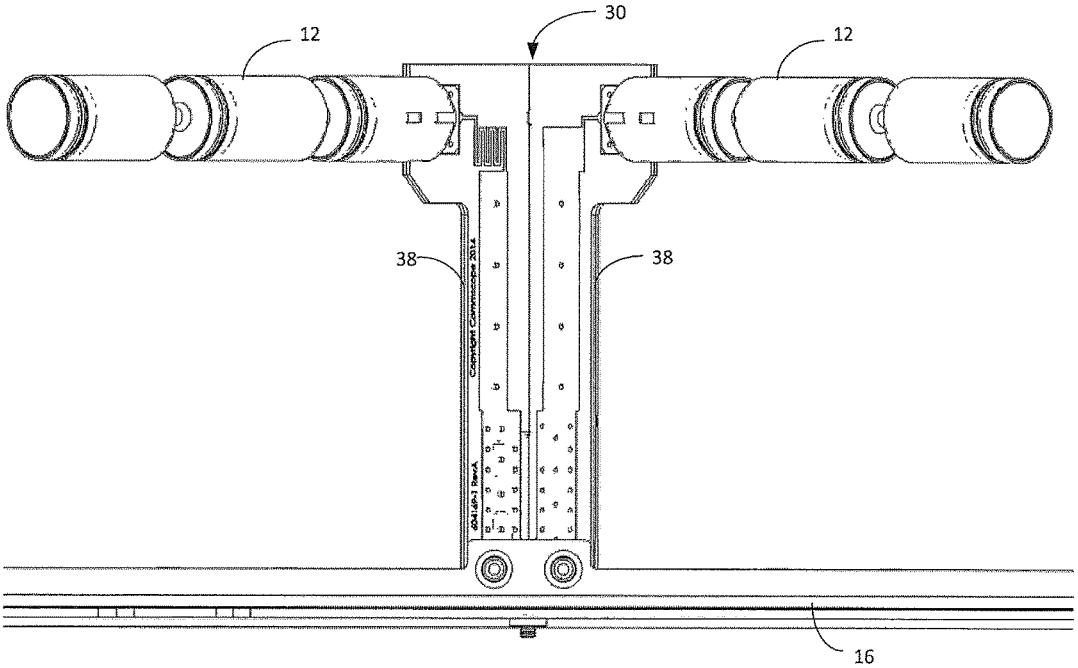
FIG. 3*a* is a side view of a low band radiating element having a stripline support PCB which may be used in combination with additional elements to provide an antenna array according to one aspect of the present invention.
Figure 3B:
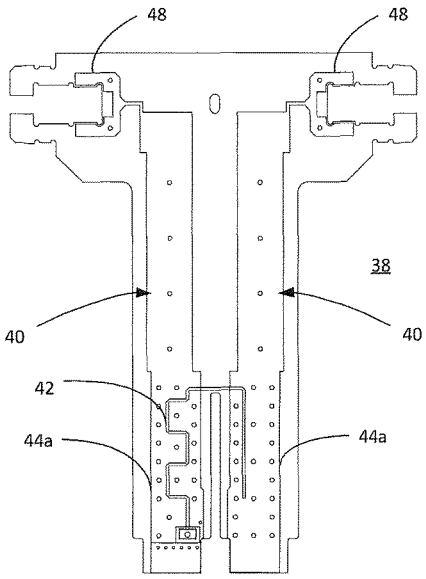
FIGS. 3*b* and 3*c* are a detailed views of the stripline support PCB of the low band element of FIG. 3*a*.
Figure 3C:
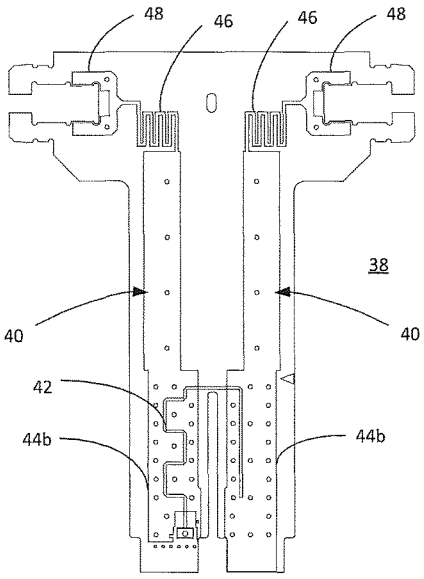

FIG. 3*a* illustrates a second example of a full wave low band dipole radiating element comprising a stripline support PCB radiating element 30. This second example has a stripline support PCB 38 in place of the microstrip support PCB 18 of FIGS. 1*a* and 1*b*. The term "stripline," as used herein, has its conventional meaning of a conducting strip sandwiched between, and separated from, two ground planes by dielectric layer(s), once again, often fabricated on a printed circuit board (PCB). In the illustrated example, the stripline support PCB radiating element 30 includes low band dipole arms 12 supported over reflector 16 by stripline support PCBs 38. FIGS. 3*b* and 3*c* illustrate metallization layers for one of the stripline support PCBs 38 of the stripline support PCB radiating element 30 of FIG. 3*a*. The stripline construction in this example comprises a hook balun 42 sandwiched between two layers of feed stalks 44*a*, 44*b*. Each stripline feed circuit 40 comprises feed stalks 44*a*, 44*b*, inductor sections 46, and capacitive sections 48.

Figure 4:
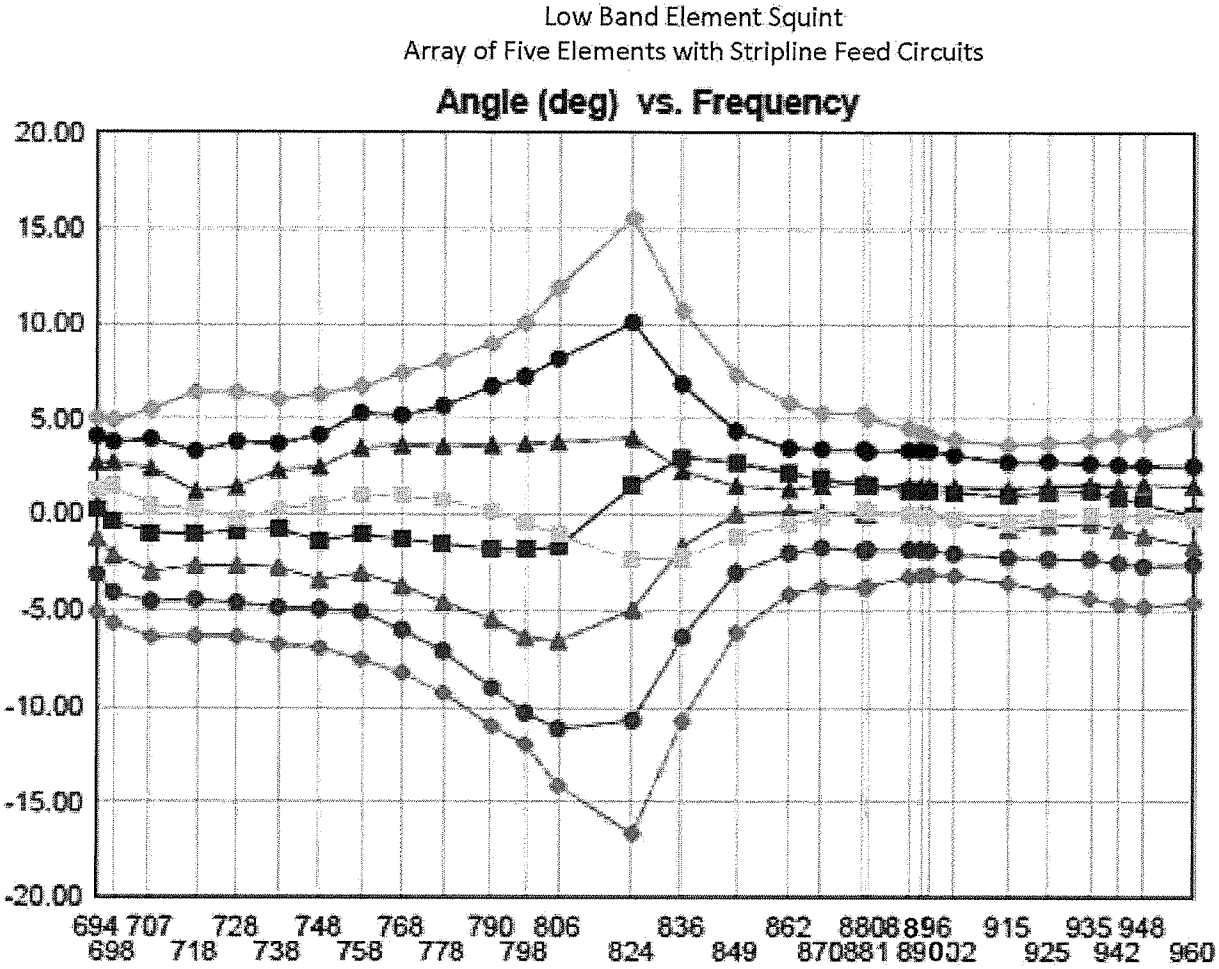
FIG. 4 illustrates squint performance of an array which is composed solely of radiating elements and stripline support PCBs as illustrated in FIGS. 3*a*-3*c*.

FIG. 4 illustrates squint degradation for an array of five stripline support PCB radiating elements 30 having full wave, low band dipole arms 12 excited by stripline support PCBs. Squint degradation increases as electrical downtilt angle increases, and the stripline feed stalk cross-talk elements exhibit a squint resonance frequency at 824 MHz. For example, squint exceeds 15° for 15° electrical downtilt at 824 MHz for both polarizations. At 10° electrical downtilt, squint exceeds 5° for much of the band.

A cellular base station antenna array having improved squint performance is now described. As used herein, "cellular" includes any type of singe point to multi-point wireless communications technology, including but not limited to, TDMA, GSM, CDMA, and LTE wireless air interfaces. "Base station antenna" includes, but is not limited to, cellular macro sites and Distributed Antenna Systems (DAS).

Figure 5:
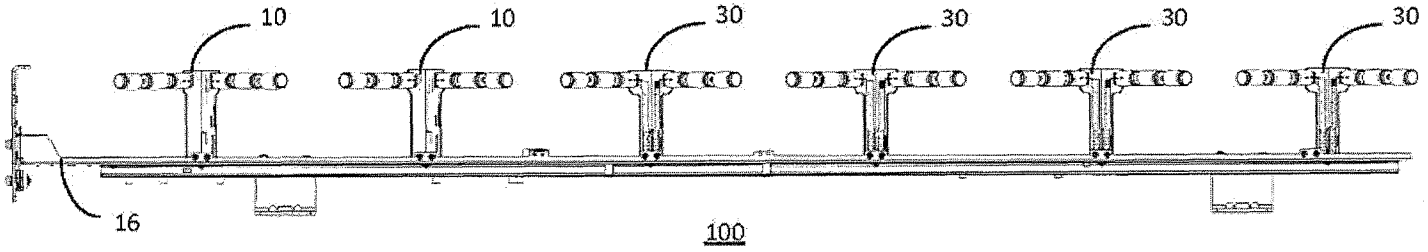
FIG. 5 is a side view of an array of radiating elements according to one aspect of the present invention.
Figure 6:
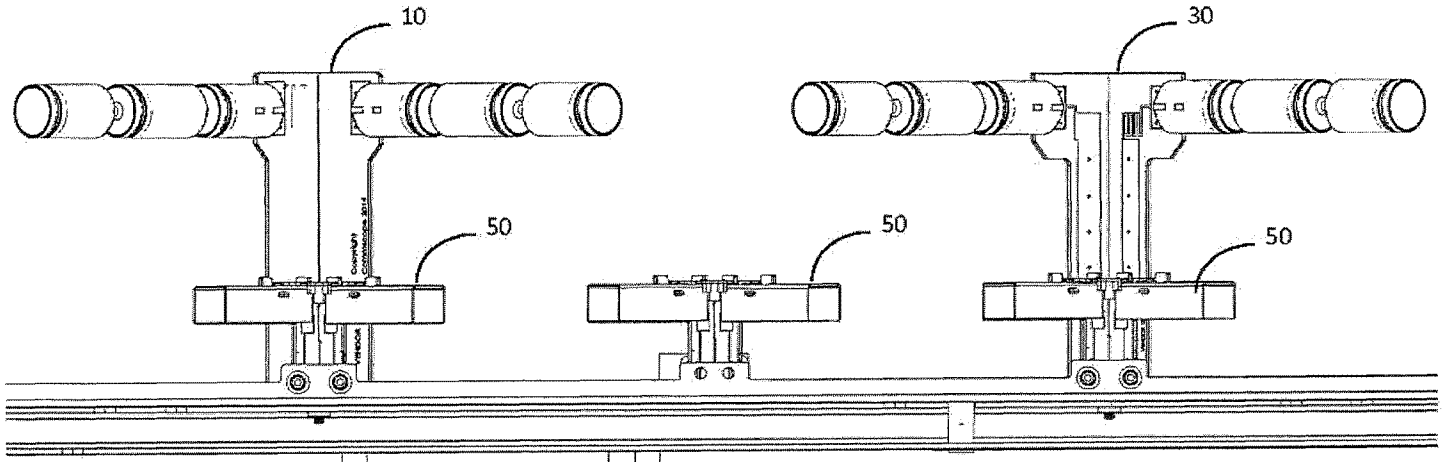
FIG. 6 is a side view of a portion of an antenna comprising high band and low band arrays of radiating elements according to another aspect of the present invention.

Referring to FIG. 5, a portion of a cellular base station antenna viewed from the side is illustrated. A plurality of microstrip support PCB radiating elements 10 and stripline support PCB radiating elements 30 are arranged in a linear array 60 over a reflector 16. The two bottom (leftmost in the illustration) microstrip support PCB radiating elements 10 employ full wave, low band dipole arms 12 and microstrip support PCBs 18 as illustrated in FIGS. 1*a* and 1*b*. The four top radiating elements (rightmost in the illustration) are stripline support PCB radiating element 30 employing full wave, low band dipole arms 12 and stripline support PCBs 38 as illustrated in FIGS. 3*a*-3*c*. FIG. 6 illustrates a portion of the base station antenna of FIG. 5 enlarged to reveal more detail with one microstrip support PCB element 10 and one stripline support PCB radiating element 30. Also illustrated are a plurality of high band elements 50 interspersed between the microstrip support PCB radiating elements 10 and stripline support PCB radiating elements 30.

Figure 7:
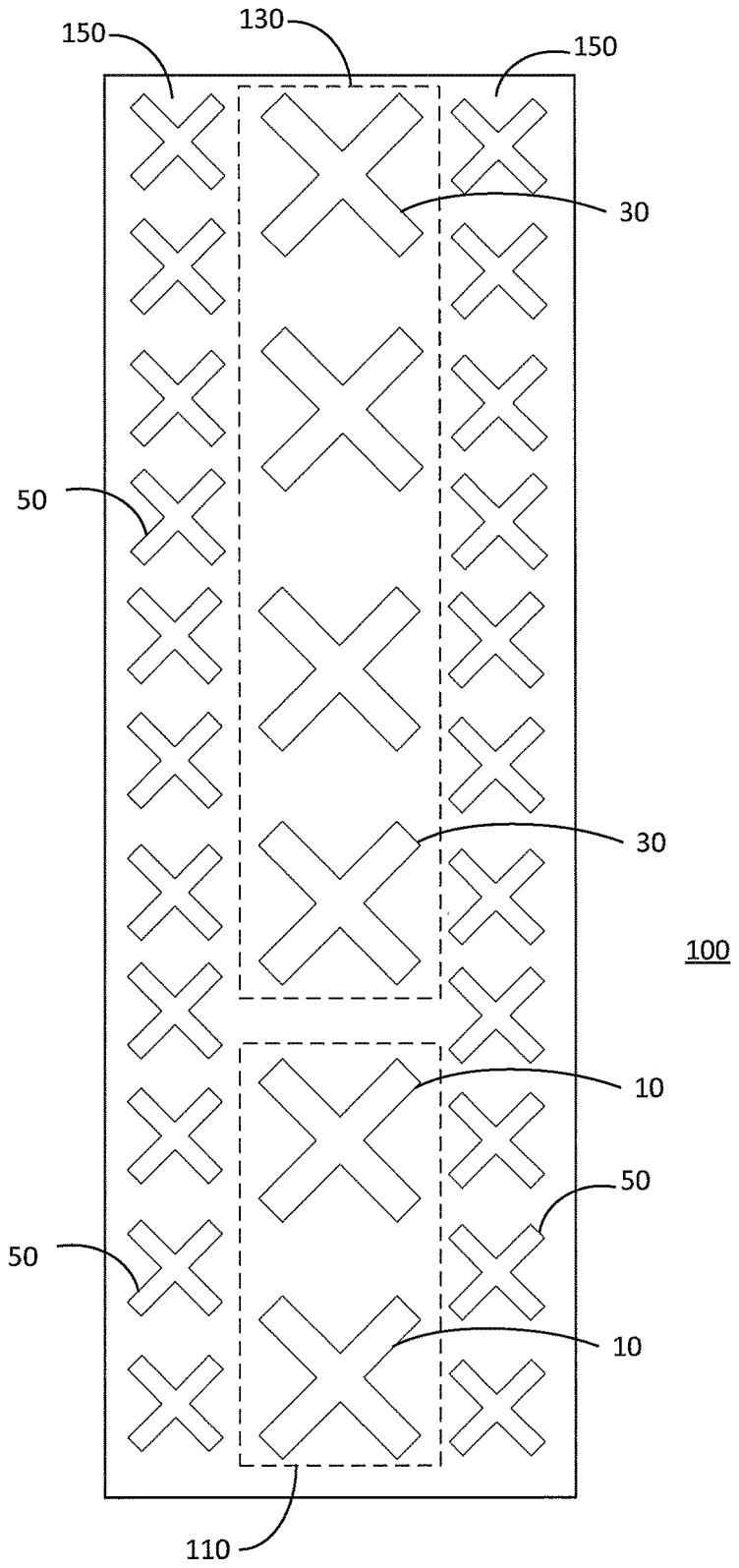
FIG. 7 is a simplified plan view of an antenna comprising high band and low band arrays of radiating elements according to another aspect of the present invention.

FIG. 7 is a schematic diagram of a dual band antenna implementing an example of the present invention. In this example, there is a single linear array 60 of low band elements, and two linear arrays 62 of high band elements, one on either side of the low band array. In this view, as in FIG. 5, the bottom two radiating elements comprise microstrip support PCB radiating elements 10 including microstrip support PCBs 18 and the top four radiating elements comprise stripline support PCB radiating elements 30 including stripline support PCBs 38. While a two microstrip/four stripline radiating element combination is illustrated in the present example, different combinations may be employed to achieve desired results. For example, longer antennas may be employed using additional elements to shape elevation beamwidth, and as a result different combinations of elements would be necessary. Also, changes to power distribution across the linear array (e.g., power taper) may also affect the optimal mix of stripline and microstrip elements. Also, while a single column of low band radiating elements may be sufficient to provide a 65° HPBW radiation pattern, additional columns of low band elements or a staggered linear array of low band elements may be employed to widen the aperture and produce narrower beam widths. Additionally, multi-column arrays may be employed in multi-beam antennas.

Figure 8:
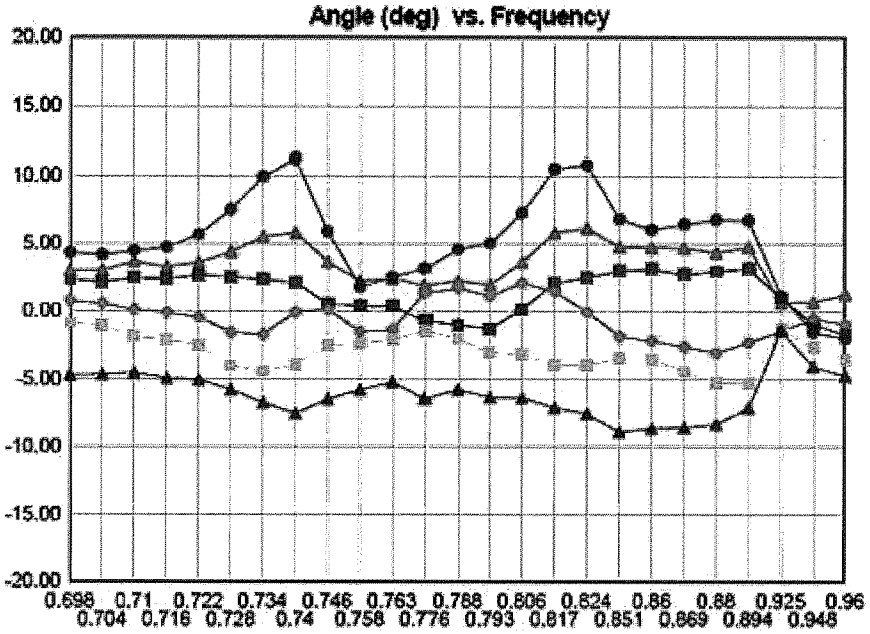
FIG. 8 illustrates squint performance of an array of radiating elements and feed circuits according to another aspect of the present invention.
Figure 9:
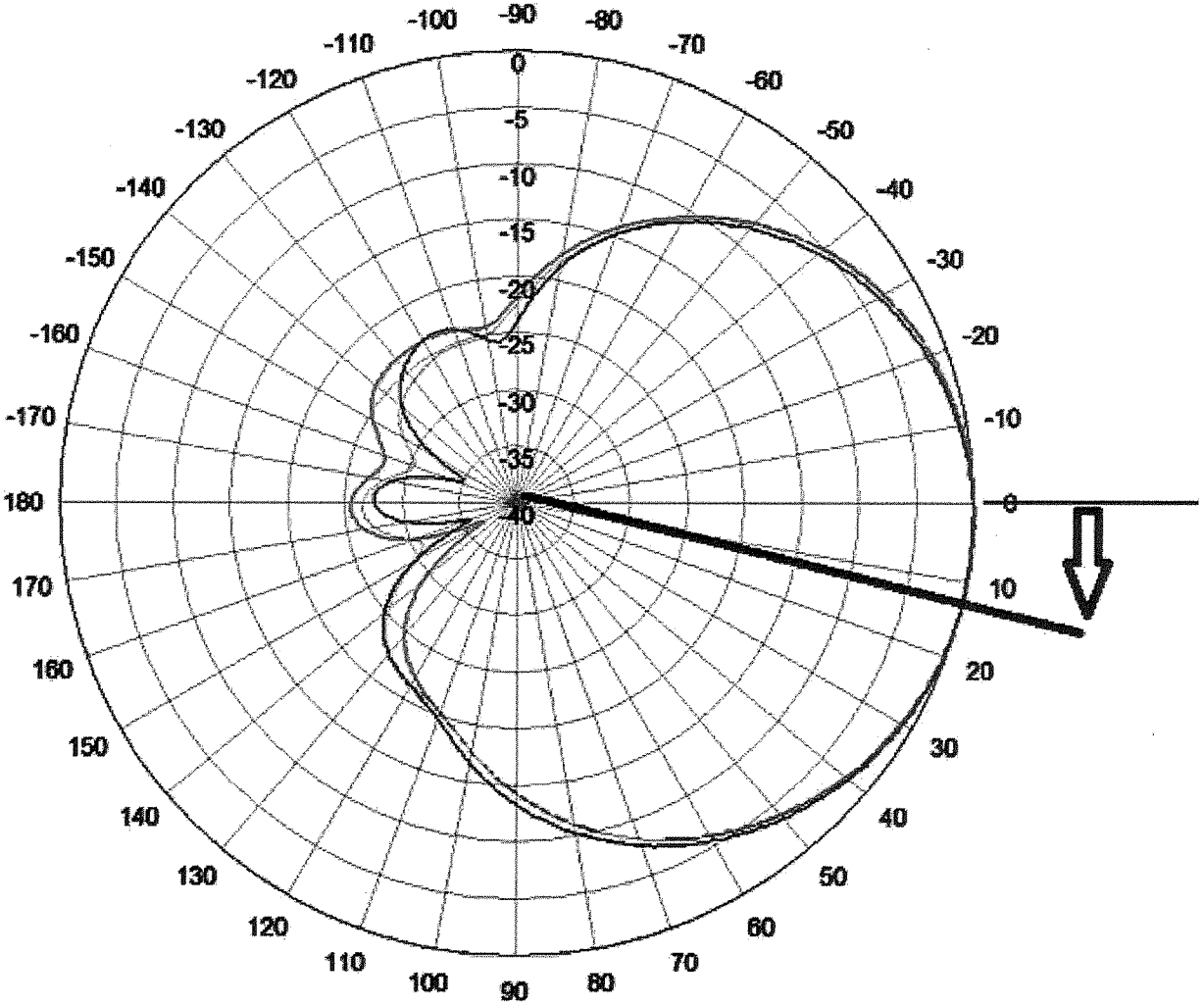
FIG. 9 is an illustration of squint of a known array of low band elements.

Referring to FIG. 8, the combination of stripline and microstrip support PCBs in an array of radiating elements results in squint performance that is improved compared to using either all stripline support PCBs or all microstrip PCBs. For example, squint is well below 15° at all frequencies at 15° of downtilt. Squint rarely exceeds 5° for other values of downtilt measured (7° and 0°). The combination of full wave dipoles and a mix of microstrip and strip line support PCBs may be advantageously used in a multiband, ultra-wideband antenna, such as the dual-band base station antenna of the '938 Application.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. We therefore claim as our invention all that comes within the scope of these claims.

What is claimed is:

1. A cellular base station antenna comprising:

a ground plane;

a first plurality of radiating elements supported over the ground plane by microstrip support PCBs; and a second plurality of radiating elements supported over the ground plane by stripline support PCBs;

wherein the first and second pluralities of radiating elements are arranged in at least one array of low band radiating elements.

2. The cellular base station antenna of claim 1, wherein the first plurality of radiating elements is located below the second plurality of radiating elements when the cellular base station antenna is mounted for use.

3. The cellular base station antenna of claim 2, wherein the first plurality of radiating elements comprises four radiating elements and the second plurality radiating elements comprises two radiating elements.

4. The cellular base station antenna of claim 1, wherein the first and second pluralities of radiating elements comprise full wave cross dipole radiating elements, and wherein the first and second pluralities of radiating elements are part of a single linear array of low band radiating elements.

5. The cellular base station antenna of claim 1, further comprising at least one array of high band radiating elements.

6. The cellular base station antenna of claim 1, further comprising:

a third plurality of radiating elements supported over the ground plane by microstrip support PCBs; and a fourth plurality of radiating elements supported over the ground plane by stripline support PCBs;

wherein the third and fourth pluralities of radiating elements are arranged in a second array of radiating elements, and wherein the first and second pluralities of radiating elements are part of a single linear array of low band radiating elements.

7. The cellular base station antenna of claim 1, wherein the quantities of first and second pluralities of radiating elements are selected to reduce squint of a beam produced by the at least one array.

8. A cellular base station antenna comprising:

a ground plane;

a first plurality of low band full wave dipole radiating elements supported over the ground plane by microstrip support PCBs;

a second plurality of low band full wave dipole radiating elements supported over the ground plane by stripline support PCBs; and at least one array of high band radiating elements;

wherein the first and second pluralities of radiating elements are arranged as a single array of low band radiating elements that are connected to the same feed circuit.

9. The cellular base station antenna of claim 8, wherein the first plurality of radiating elements is located below the second plurality of radiating elements when the cellular base station antenna is mounted for use.

10. The cellular base station antenna of claim 8, wherein the microstrip support PCBs each comprise a hook balun, a feed stalk, an inductive section, and a capacitive section.

11. The cellular base station antenna of claim 8, wherein the stripline support PCBs each comprise a book balun, at least two feed stalks sandwiching the hook balun, an inductive section, and a capacitive section.

12. A cellular base station antenna, comprising:

a plurality of first radiating elements and a plurality of second radiating elements that together form a first linear array of radiating elements that operates in a first frequency band a plurality of third radiating elements that form a second linear array of radiating elements that operates in a second frequency band that is different from the first frequency band;

wherein each of the first radiating elements has a first type of support that supports dipoles of the respective first radiating elements above a around plane, and each of the second radiating elements has a second type of support that supports dipoles of the respective second radiating elements above the ground plane, wherein the second type of support is different from the first type of support.

13. The cellular base station antenna of claim 12, wherein the first type of support comprises a microstrip support printed circuit board ("PCB") and the second type of support comprises a stripline support PCB.

14. The cellular base station antenna of claim 13, wherein the first frequency band is at frequencies that are lower than frequencies of the second frequency band.

15. The cellular base station antenna of claim 14, wherein the first radiating elements are, at a first end of the first linear array and the second radiating elements are at a second end of the first linear array that is opposite the first end.

16. The cellular base station antenna of claim 12, wherein each of the first radiating elements and each of the second radiating elements include a pair of full wave dipole arms.

17. The cellular base station antenna of claim 6, wherein the full wave dipole arms all have the same design.

18. The cellular base station antenna of claim 12, wherein the number of first radiating is different from the number of second radiating elements.

19. The cellular base station antenna of claim 12, further comprising a plurality of fourth radiating elements that form a third linear array of radiating elements that operates in the second frequency band, wherein the first linear array is between the second and third linear arrays.

20. The cellular base station antenna of claim 12, wherein a number of first radiating elements and a number of second radiating elements are selected to reduce squint of a beam produced by the first linear array.

* * * * *